United States Patent [19]

Thompson et al.

[11] 4,213,545

[45] Jul. 22, 1980

[54] EXPANDING BELLOWS FOR EXPULSION TANK

[75] Inventors: Leo M. Thompson, Niagara Falls; John Z. Colt, Williamsville; Robert J. Szpakowski, Kenmore, all of N.Y.

[73] Assignee: Textron, Inc., Providence, R.I.

[21] Appl. No.: 943,948

[22] Filed: Sep. 20, 1978

[51] Int. Cl.[2] ..... B67D 5/54

[52] U.S. Cl. ..... 222/386.5; 92/42; 138/30; 220/85 B; 222/389

[58] Field of Search ..... 138/30; 92/42, 45; 220/85 B; 222/386.5, 389

[56] References Cited

U.S. PATENT DOCUMENTS

| | | | |
|---|---|---|---|
| 1,561,065 | 11/1925 | Eggleston | 92/42 |
| 2,798,639 | 7/1957 | Urban | 220/85 B |
| 2,963,043 | 12/1960 | Davis et al. | 92/42 |
| 3,090,403 | 5/1963 | Kroekel | 92/45 X |
| 3,159,182 | 12/1964 | Peters | 138/30 |

*Primary Examiner*—David A. Scherbel
*Attorney, Agent, or Firm*—Bean, Kauffman & Bean

[57] ABSTRACT

A positive expulsion tank incorporates an expanding bladder in the form of a metal bellows, which is adapted to undergo elastic deformation during a product storage condition to provide for thermal cycling of a stored product, and plastic deformation, during a product expulsion operation to achieve high efficiency expulsion of product from the tank. Convolution crests of the bellows are internally reinforced by rings, whereby plastic deformation of the bellows is caused to occur primarily in the root areas during the expulsion operation. As a result, the root areas are displaced radially outwardly towards the wall of the tank incident to axially directed extension of the bellows to lie in essential alignment with their adjacent crests when the bellows has been fully extended to complete the expulsion operation, thereby providing for expulsion efficiencies in excess of 97 percent.

7 Claims, 7 Drawing Figures

FIG. 2.

Fig. 1.
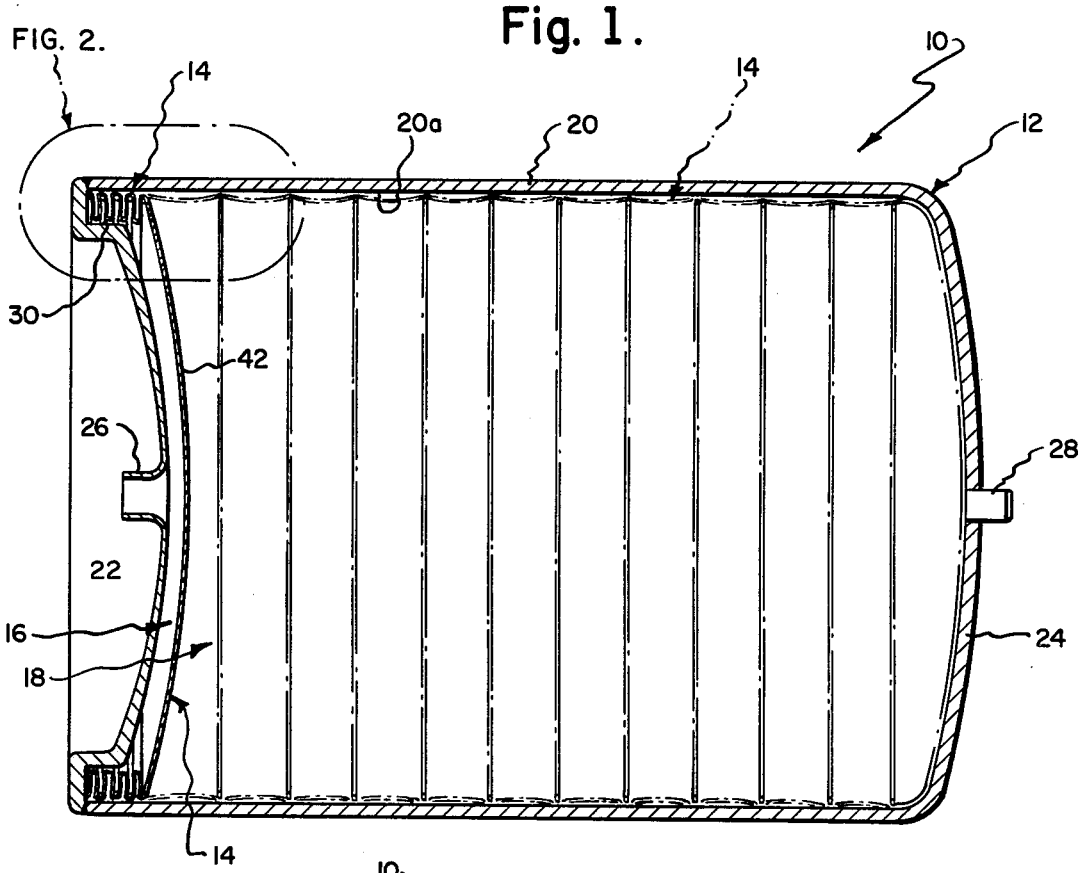
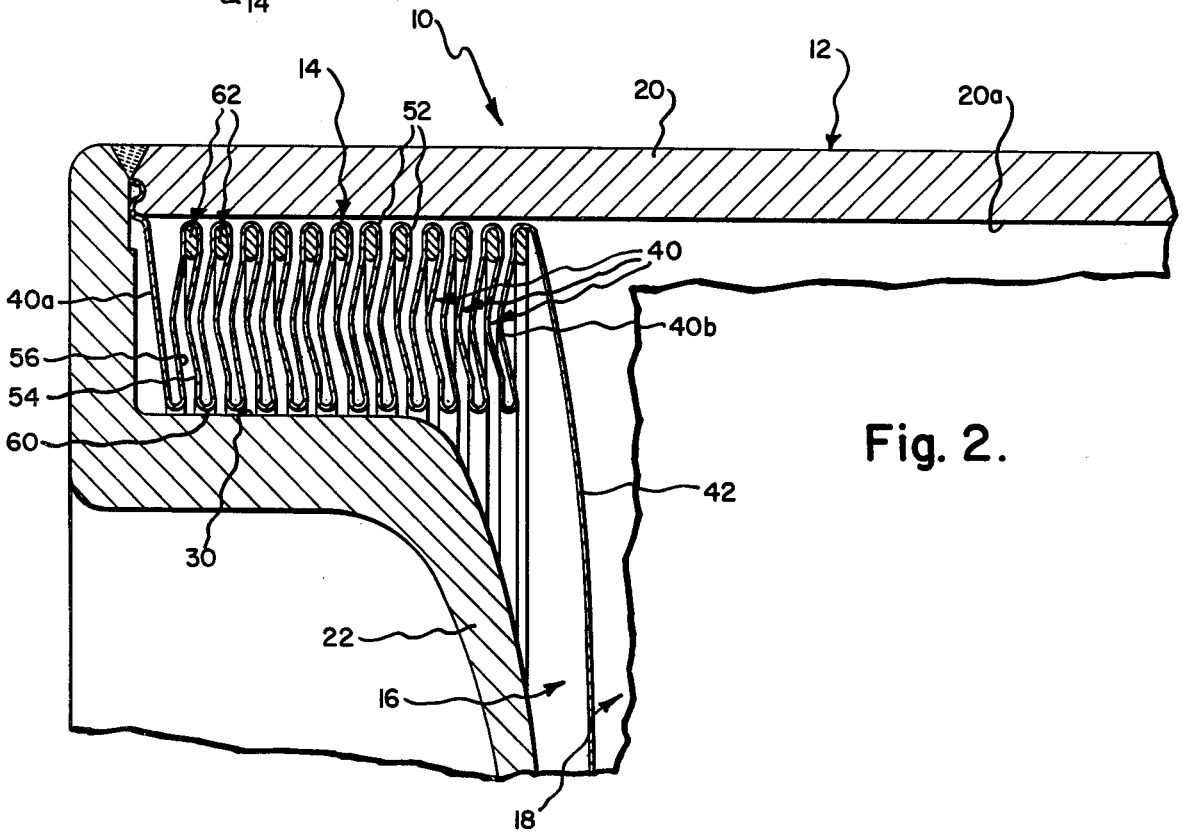
Fig. 2.

EXPANDING BELLOWS FOR EXPULSION TANK

BACKGROUND OF THE INVENTION

Expulsion tank constructions of the non-spherical variety feature a tank shell having first and second ends and a generally cylindrical side wall for joining such ends; a bladder fixed within the tank shell and cooperating therewith to define product storage and expulsion fluid chambers; and expulsion fluid inlet/outlet means carried by the tank shell in flow communication with the product storage and expulsion fluid chambers, respectively. Bladders used in such tanks may be variously defined, as by metal bellows, rolling metal diaphragms, and by rubber or plastic expansible and/or collapsible bladders.

Heretofore, when employing a bladder in the form of a metal bellows, the product is commonly disposed within the bellows and expelled from the tank incident to an axially directed compression or collapse of the bellows, in the manner shown for instance in U.S. Pat. No. 3,296,803 to Kroekel.

U.S. Pat. No. 3,469,502 to Gardner is of interest for its disclosure of the operational characteristics of a conventional bellows and particularly for its discussion of factors establishing the limiting modes of extreme compression and extreme extension of bellows designs featuring different convolution side wall configurations. The curved convolution side wall configuration to which the Gardner patent is directed has been used commercially in expulsion tank structures of the general type described in the above mentioned Kroekel patent, due to the relatively large deflection ratio obtainable therewith, as compared to prior bellows side wall configurations.

Thus, in prior applications of a Gardner bellows in a positive expulsion tank, such bellows has functioned in a compressive mode, during the product expulsion operation. The limiting mode of extreme extension would correspond to the product cavity full condition, wherein the convolution side walls preferably retain some degree of curvature in order to accommodate for temperature induced expansion/contraction of the stored product. The limiting mode of extreme compression would correspond to the product cavity empty condition, wherein the convolution side walls preferably nest in surface to surface engagement in order to expel all products from within the confines of the convolutions.

Recognizing the deflection limitations placed upon a collapsing bellows by its limiting modes of expansion and compression, and resultant modest product storage capabilities, tests have been conducted using a Gardner type bellows to effect product expulsion incident to expansion of the bellows to and beyond its limiting mode of extreme extension. It was found that extensions beyond the limiting mode of extension result in buckling failure of the bellows accompanied by a marked increase in the pressure required to extend the bellows beyond this point. Tearing of the bellows material incident to serious buckling of the crest portions of the convolutions coupled with substantial increases in required expulsion pressure have heretofore placed a definite limitation on the utilization of an expanding bellows in a positive expulsion tank.

In addition to the above discussed Kroekel and Gardner patents, U.S. Pat. No. 2,798,639 to Urban and U.S. Pat. No. 3,847,309 to Grossman are cited as being of possible interest to the state of the art relating to the present invention.

The Grossman patent is representative of numerous prior patents disclosing expulsion tanks utilizing a rolling metal type diaphragm; this patent being specifically mentioned for its showing of the utilization of rings to reinforce the cylindrical wall of a rolling diaphragm and strengthen same against buckling pressure of a pressurizing medium. The buckling phenomena characteristic of a rolling diaphragm type expulsion bladder is not related directly to the buckling phenomena characteristic of a bellows type bladder, in that with the latter buckling limits of extreme compression or extension are independent of the pressure of the expulsion fluid effecting operations of the bellows intermediate these extremes.

U.S. Pat. No. 2,798,639 is believed representative of numerous patents suggesting reinforcement of crests and/or root portions of a bellows when such bellows is fabricated from a pliable, non-metallic material, including for instance cloth, rubber and plastic, in order to rigidify the convolutions and prevent deformation thereof under normal bellows operating conditions, due to the necessary pressure differential existing across the bellows walls. In a metallic bellows of the type intended for use in an expulsion tank, the rigidity or structural strength of the convolutions of the bellows is sufficient to prevent radially directed expansion or collapse of the convolution, due to pressure differentials existing across the bellows walls.

SUMMARY OF THE INVENTION

The present invention is primarily directed towards the concept of extending an axially expansive bellows beyond its limiting mode of extension; the crest portions of the bellows being reinforced with ring devices whereby to cause plastic deformation of material to occur primarily in the root areas during an expulsion operation. As a result, the root areas expand radially outwardly to lie in essential alignment with their adjacent crest portions and in close proximity to the side wall of the tank shell at the completion of an expulsion operation to thereby achieve expulsion efficiencies substantially in excess of prior art bellows operated in a deflection range intermediate their limiting modes of extension and compression.

Various bellows geometries are disclosed, namely, a first form in which the bellows convolutions are of uniform radial dimension throughout the length of the bellows, when in axial compressed condition; and alternate forms wherein the radial dimensions of the bellows convolutions are stepwise increased in the direction of expansion of the bellows to permit fitting of the bellows at least partially within the confines of one curved end portion of the tank shell. The alternate forms of the invention require more expensive manufacturing techniques, but have greater product recovery efficiencies for any tank installation of a given length and diameter.

DRAWINGS

The present invention will now be described in detail in the following description taken with the accompanying drawings wherein:

FIG. 1 is a sectional view taken lengthwise through a positive expulsion tank showing the present invention;

FIG. 2 is an enlarged sectional view of the area designated as FIG. 2 in FIG. 1;

DETAILED DESCRIPTION

Figure 3A:
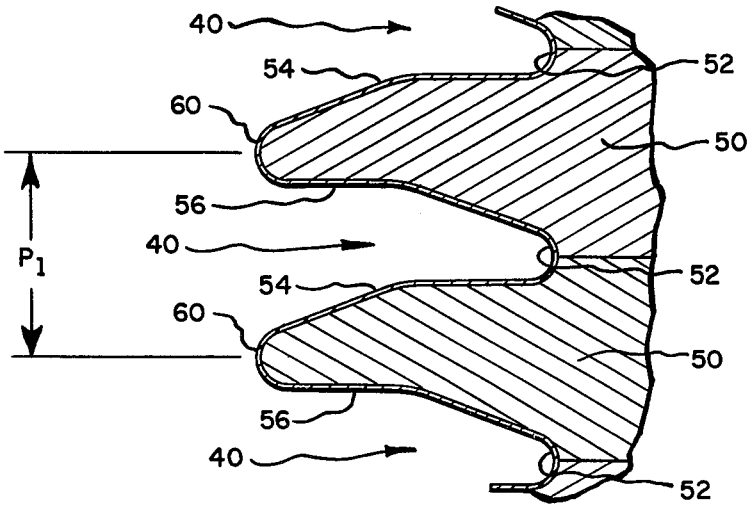
FIGS. 3a–3c are fragmentary sectional views illustrating the present mode of fabricating a bellows.

Reference is now made to FIGS. 1 and 2, wherein a positive expulsion tank is generally designated as 10 and shown as including a tank shell 12 and an expansible expulsion bladder in the form of a metal bellows 14, which serves to divide the tank into expulsion fluid receiving and product storage chambers 16 and 18 respectively.

Tank shell 12 is shown in FIG. 1 as having a cylindrical central or sidewall portion 20 and opposite end wall portions 22 and 24, which are bowed to assume an ellipsoidal or generally hemispherically shaped configurations in order to better withstand internal tank pressures. End wall portions 22 and 24 would normally be fitted with valve controlled expulsion fluid inlet means and a product outlet means, which are generally designated as 26 and 28 and arranged for flow communication with chambers 16 and 18, respectively. End wall 22 is additionally characterized as having a peripherally located, annular recess 30, which opens axially of the tank towards end wall 24 and is sized to receive bellows 14 when the latter is in its axially compressed or tank full configuration illustrated by full line in FIGS. 1 and 2. The axially extended or tank empty configuration of bellows 14 is shown in broken line in FIG. 1.

In accordance with the preferred form of the present invention, bellows 14 is formed with a plurality of uniformally sized convolutions 40, wherein one end convolution 40a is fixed, as by welding, to the tank shell adjacent the juncture of the sidewall 20 and end wall 22, and an opposite end convolution 40b is suitably fixed to or formed integrally with a piston head 42 arranged to extend transversely of side wall 20. Piston head 42 would preferably be of a configuration conforming essentially to the configurations of end walls 22 and 24 in order to maximize product storage capacity and expulsion efficiency of tank 10.

Now referring to FIG. 3a, it will be understood that the bellows is suitably fabricated, such as by fluid pressure deforming a seamless metal tube, not shown, within a press or mold comprising a plurality of segmented, annularly extending forming dies 50 to define a plurality of convolutions 40. Each of convolutions 40 includes an annularly extending and radially inwardly opening crest portion 52 and sidewall portions 54 and 56, which are joined to sidewall portions of adjacent convolutions by an annularly extending and radially outwardly opening root portion 60. In the illustrated construction, convolution sidewalls 54 and 56 are considered to be leading and trailing in the direction of axial expansion of the bellows from its compressed or tank full configuration into its extended or tank empty configuration illustrated in FIG. 1.

Figure 3B:
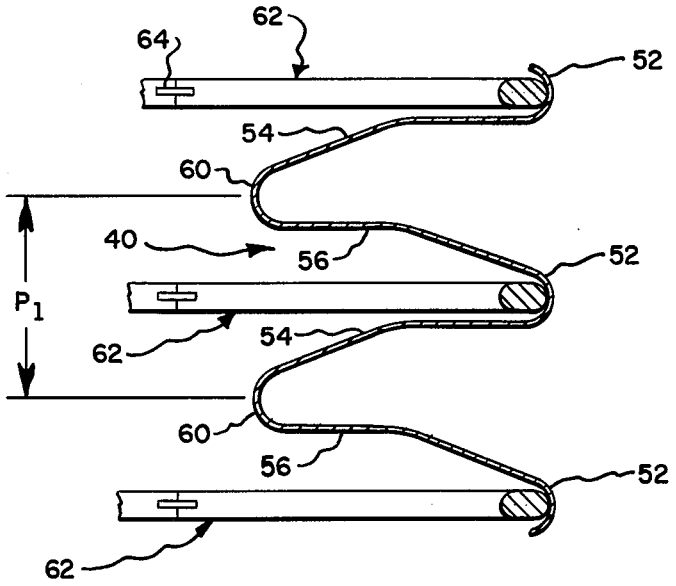

As formed, convolutions 40 are characterized as having a given pitch $P_1$, as measured between centers of either adjacent crests or roots, and in that facing surfaces of sidewall portions 54 and 56 of each convolution are bowed to assume convex and concave configurations, respectively. The value of pitch $P_1$ will depend primarily on fabricating considerations, but preferably would provide for the illustrated convolution geometry, wherein sidewall portions are spaced apart sufficiently to permit snap fitting of reinforcing elements, such as metal split rings 62, into crest portions 52 in the manner indicated in FIG. 3b. Preferably, the ends of the inserted rings 62 are locked in aligned, abutting relationship by any suitable means, such as keys 64.

Figure 3C:
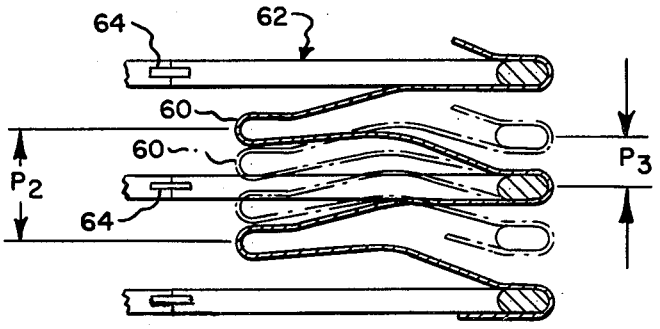

After insertion of rings 62, fabrication of the bellows is completed by deforming crest portions 52 to closely follow the contour of the rings and reduce the pitch of the convolutions to a second or as fabricated pitch $P_2$, as indicated in full line in FIG. 3c. This operation serves to firmly hold the rings in place and effects stiffening of the crest portions. Preferably, radial spacing existing between rings 62 and deformed crest portion 52 would be kept as small as possible so as to minimize buckling and resultant movement of the crest portions radially inwardly and away from the inner surface 20a of tank sidewall portion 20 during the expulsion operation. Deformation of crest portions 52 may be variously effected, such as by performing a die rolling operation or by subjecting the bellows to axial compression. Preferably, the radius of curvature of root portions 60 would be reduced incident to deformation of the crest portions in the manner described above.

The fabricated bellows is attached to piston head 42, if separately formed, and then fixed within tank shell 12 in the manner described above in reference to FIG. 2 with the radially outer surface of crest portions 52 disposed in close proximity to sidewall portion 12. Thereafter, a charge of product is introduced into chamber 18 at room temperature, and as an incident thereto bellows 14 is partially compressed to assume its tank full configuration wherein the spacing of convolutions 40 is reduced to a third or tank full pitch shown in phantom line and designated as $P_3$ in FIG. 3c. A preferred method of charging chamber 18 would include drawing a vacuum in chamber 16 in order to compress or collapse bellows 14 into its tank full configuration, filling chamber 18 with product and finally releasing the vacuum.

It will be understood that the design of bellows 14 is such that convolutions 40 are free to undergo resilient deformation incident to flexures thereof between their as fabricated spacing or pitch $P_2$ and a fully nested condition, not shown, wherein sidewall portions are disposed in essentially surface-to-surface engagement. Nesting of the convolution sidewall portions in the absence of plastic deformation is facilitated by their as formed bowed configurations illustrated in the drawings. Flexures of bellows 14 between these extremes accommodates for fluctuations in the volume of the stored product produced by product storage temperatures ranging between given or design maximum and minimum values. In other words, bellows 14 is designed to reside under tank full conditions in a normal bellows operating mode intermediate its limiting modes of extreme compression and extreme extension in order to permit resilient flexures of the bellows to accommodate for temperature induced fluctuation in volume of the stored product.

Upon the opening of inlet and outlet means 26 and 28, the resultant difference in pressure across piston head 42 effects axial extension of bellows 14 into its tank empty condition, wherein the piston head lies in close proximity to end wall 24 and the sidewall and root portions of convolutions 40 are essentially aligned with the convolution crest portions and disposed in close proximity to tank shell sidewall portion 20. As previously indicated, rings 62 serve to constrain buckling induced movements of the crest portions inwardly away from tank shell sidewall portion 20, which would otherwise result in the entrapment of a large volume of product within tank 10 upon completion of piston head travel. On the other hand, root portions 60 and side wall portions 54 and 56 undergo plastic deformation incident to axial expansion of the bellows, such that the root portions expand or are drawn radially outwardly towards tank side wall portion 20 to lie in essential alignment with their adjacent crest portions at the completion of the expulsion operation. In practice, the sidewall of the fully extended bladder is not truly cylindrical, but it is nonetheless possible to achieve product expulsion efficiencies in excess of 97 percent. Of course, the size and number of convolutions required to achieve maximum expulsion efficiency will vary with tank size and geometry.

Preferably, the design of bellows 14 is such that its limiting mode of extreme extension is reached coincident with or shortly after initiation of the expulsion operation, such that controlled plastic deformation of the convolution sidewall and root portions occurs through at least a substantial portion of the expulsion operation. The constraint afforded crest portion 52 provides for controlled plastic deformation of the sidewall and root portions in a manner which avoids wrinkle induced puncture failure commonly encountered in a conventional bellows when extended substantially beyond its limiting mode of extreme extension. Also, as a result of this controlled deformation, the pressure required to fully extend the present bellows of a given wall thickness may be substantially reduced.

Figure 4:
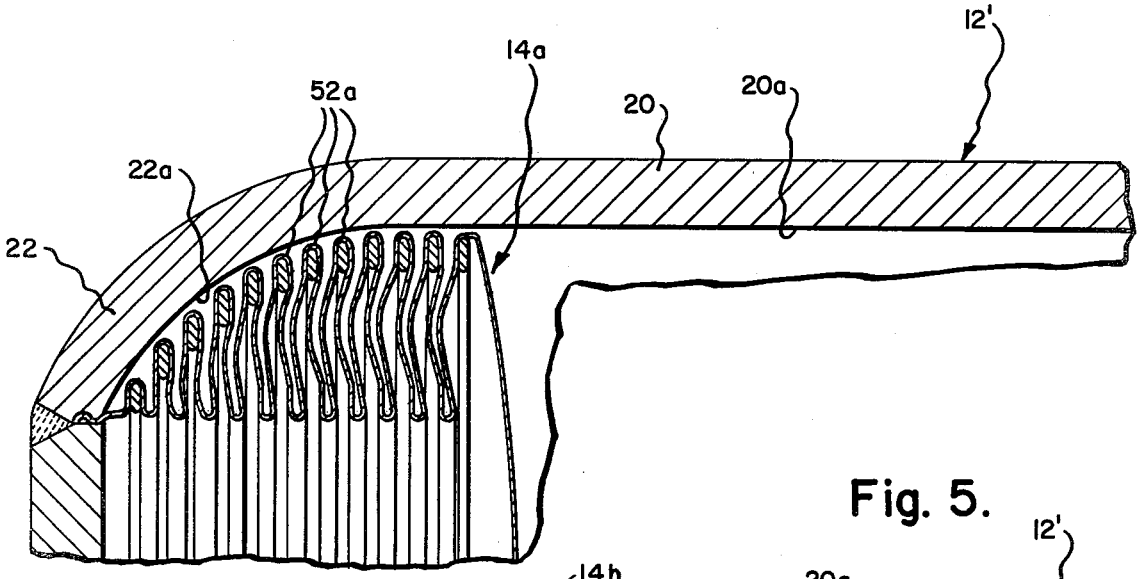
FIGS. 4 and 5 are enlarged sectional views similar to FIG. 2, but illustrating alternate forms of the present invention.
Figure 5:
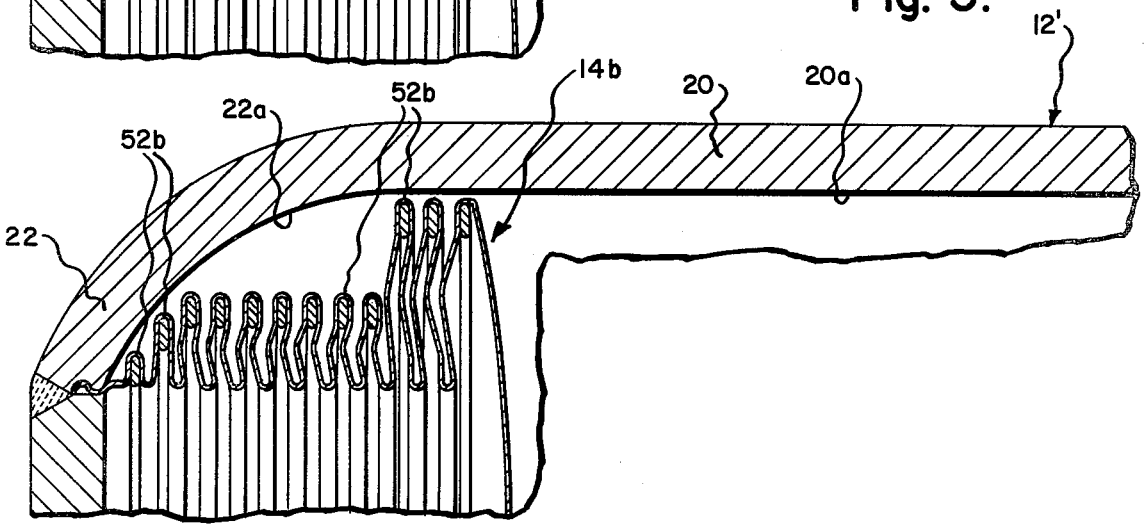

Reference is now made to FIGS. 4 and 5 wherein two alternative forms of the present bellows construction are designated as **14*a* and 14*b*, respectively, and shown as being installed in a modified tank shell 12*a*. Tank shell 12*a* is characterized in that end wall portion 22 defines an inwardly facing concave surface 22*a* forming an extension of the cylindrical surface 20*a* of sidewall portion 20. Bellows 14*a* and 14*b* are also shown as being installed, such that when in tank full configuration, they are disposed at least in part in radial alignment with surface 22*a*. Further, in the forms of the invention illustrated in FIGS. 4 and 5, those convolutions of bellows 14*a* and 14*b*, which are aligned with surface 22*a*, are characterized in that the radial dimensions of their crest portions 52*a* and 52*b* increase in a stepwise manner and in a direction extending axially away from end wall portion 22. These bellows designs differ in that for the case of bellows 14*a*, successive ones of crest portions 52*a*** are of progressively increasing size.

The constructions illustrated in FIGS. 4 and 5 have a lower potential expulsion efficiency than the constructions illustrated in FIGS. 1 and 2, but for a tank of given length and diameter permit an overall reduction in the weight of the tank shell. As between these alternative constructions, bellows **14*a*** has a high expulsion efficiency, but requires more costly tooling to fabricate.

What is claimed is:

1. In a positive expulsion tank having a tank shell defined by first and second end walls and a side wall connecting said end walls; a bellows arranged within said tank shell and cooperating therewith to define product storage and expulsion fluid chambers, said bellows having one end fixed to said tank shell and an opposite end closed by a piston head extending transversely of said side wall, said bellows having convolutions consisting of crest portions, joining side wall portions, and root portions for connecting side wall portions of adjacent convolutions, said bellows being axially extendible under control of expulsion fluid within said expulsion fluid chamber to position said piston head adjacent alternate ones of said end walls of said tank shell to define product chamber full and empty conditions of said tank, said bellows having limiting modes of extreme compression and extreme extension bounding a normal operating mode in which said convolutions may undergo resilient deformation and beyond which plastic deformation of said convolutions occurs; and product and expulsion fluid flow control means mounted by said tank shell for flow communication with said product storage and expulsion fluid chambers, respectively, the improvement comprising in combination:

a plurality of reinforcing rings fixed one within each of said crests and operable to limit radially inwardly directed plastic deformation thereof away from said side wall of said tank shell incident to axial extension of said bellows beyond said limiting mode of extreme extension, said bellows being fixed within said tank shell to perform in said normal operating mode incident to said product chamber full condition of said tank to accommodate for temperature induced expansions/contractions of said stored product, said bellows being sized to undergo plastic deformation without puncture failure of said convolutions incident to axial extension thereof beyond said limiting mode of extreme extension into said product chamber empty condition, and said root portions being displaced radially outwardly towards said side wall of said tank shell incident to said axial extension of said bellows to lie in essential alignment with adjacent ones of said crest portions when said bellows is disposed in said product chamber empty condition.

2. The improvement according to claim 1, wherein said rings are split rings having their respective end surfaces fixed in aligned abutting engagement.

3. The improvement according to claim 1, wherein said side wall of said tank shell is of cylindrical configuration, said bellows when in said normal operating mode is disposed in radial alignment with said side wall, said convolutions are of essentially like size, and said crest portions are disposed to lie in close proximity to said side wall of said tank shell.

4. The improvement according to claim 1, wherein at least one of said end walls of said tank shell defines an inwardly facing concave surface, said bellows when in said normal operating mode is disposed at least in part for radial alignment with said concave surface, and the radial dimensions of successive ones of said crest portions of that part of said bellows disposed for radial alignment with said concave surface progressively increasing in a direction extending from said one end towards said opposite end of said bellows.

5. The improvement according to claim 1, wherein at least one of said end walls of said tank shell defines an inwardly facing concave surface, said bellows when in said normal operating mode is disposed at least in part for radial alignment with said concave surface, and the radial dimensions of said crest portions of that part of said bellows disposed for radial alignment with said concave surface increase in a stepwise manner in a direction extending from said one end towards said opposite end of said bellows.

6. The improvement according to claim 1, wherein the radial dimensions of said crest portions when said bellows is in said normal operating mode increase in a stepwise manner in a direction extending from said one end towards said opposite end of said bellows.

7. The improvement according to claim 6, wherein the radial dimensions of said root portions of said bellows when in said normal operating mode are essentially uniform.

* * * * *